US007424782B2

(12) United States Patent
Cheskin

(10) Patent No.: US 7,424,782 B2
(45) Date of Patent: Sep. 16, 2008

(54) ELECTRICALLY CONDUCTIVE SHOE AND SYSTEM

(76) Inventor: Melvyn Cheskin, 23354 Water Cir., Boca Raton, FL (US) 33483

( * ) Notice: Subject to any disclaimer, the term of this patent is extended or adjusted under 35 U.S.C. 154(b) by 573 days.

(21) Appl. No.: 10/493,655

(22) PCT Filed: Oct. 23, 2001

(86) PCT No.: PCT/US01/50973

§ 371 (c)(1),
(2), (4) Date: Aug. 24, 2004

(87) PCT Pub. No.: WO03/037045

PCT Pub. Date: May 1, 2003

(65) Prior Publication Data

US 2005/0016030 A1 Jan. 27, 2005

(51) Int. Cl.
*A43B 7/36* (2006.01)
*A43B 7/00* (2006.01)

(52) U.S. Cl. ..... 36/9 R; 36/32 R; 36/68; 361/224

(58) Field of Classification Search ..... 36/32 R, 36/44; 361/223, 224; 2/239, 902, 905
See application file for complete search history.

(56) References Cited

U.S. PATENT DOCUMENTS

| | | | | |
|---|---|---|---|---|
| 2,287,744 | A | 6/1942 | Monahan | |
| 2,671,185 | A | 3/1954 | Bloom | |
| 2,955,234 | A | 10/1960 | Price | |
| 3,281,624 | A | 10/1966 | Patchen | |
| 4,785,371 | A | 11/1988 | Edwards | |
| 5,319,867 | A | 6/1994 | Weber | |
| 5,448,840 | A | 9/1995 | Cheskin | |
| 5,786,977 | A * | 7/1998 | Cohen | 361/223 |
| 6,003,247 | A * | 12/1999 | Steffe | 36/45 |
| 6,721,161 | B2 * | 4/2004 | Lee et al. | 361/223 |
| 6,982,861 | B2 * | 1/2006 | Lee et al. | 361/223 |
| 7,055,266 | B2 * | 6/2006 | Elsey | 36/30 R |

FOREIGN PATENT DOCUMENTS

| | | | |
|---|---|---|---|
| CH | 635234 A5 * | 3/1983 | |

* cited by examiner

*Primary Examiner*—Jila M Mohandesi
(74) *Attorney, Agent, or Firm*—Melvin K. Silverman; Yi Li

(57) ABSTRACT

A shoe for enhancing human physical performance by establishing an electrical conduit between the body and the ground includes a shoe outsole formed of a conductive rubber material. A resilient conductive element is integral with the outsole and extends along a heel of the shoe upper along its outer surface. The tape extends into the interior of the shoe and contacts a conductive sock liner. Thus the foot is in constant electrical connection with the outsole. A conductive sock may be employed to provide a more reliable electrical path to the sock liner and thereby to the ground.

7 Claims, 10 Drawing Sheets

ELECTRICALLY CONDUCTIVE SHOE AND SYSTEM

BACKGROUND OF THE INVENTION

1. Field of the Invention

The present invention relates to shoes containing electrically conductive components and, more particularly, to an integral shoe design having an electrically conductive component for providing an electrical conduit between the user's foot and the ground for enhancing human physical performance.

2. Description of the Related Art

This invention is an improvement of my U.S. Pat. No. 5,448,840 (1995), entitled Shoe Containing Electrically Conductive Integral Elements. The invention more particularly relates to efficient means of providing a path of electrical conduction between the outsole of the shoe and the foot of the user and, as well, relates to a conductive sock particularly adapted for use therewith.

Typically, shoes are completely comprised of electrically non-conductive components or, they are partially comprised of components that do not provide an electrical conduit between the wearer's foot and the ground. The wearer's foot is typically insulated from the ground, particularly in athletic footwear, where the shoe sole is typically comprised of non-conductive rubber or other polyurethane or synthetic soling material.

It has been known for many years to provide electrically conductive components in connection with footwear that exhibit the ability to conduct electrical charge to ground for various purposes. For example, U.S. Pat. No. 2,305,542 discloses a process for rendering leather conductive, and U.S. Pat. No. 3,013,184 discloses a "booty" with an electrically conductive sole. Other footwear exhibiting a lesser ability to conduct electrical charge has been used, for example, by persons in the electronic and computer industries who must void and/or discharge static electricity that may build up on their clothing and body. Various methods have been proposed for causing static electricity to be discharged from the body and clothing and these expedients have often resulted in cumbersome, expensive and poorly designed shoes. For example, body-grounding straps are disclosed in U.S. Pat. Nos. 2,586,747 and 2,712,098. Other antistatic or conductive straps in various forms and for various purposes have been disclosed, for example, in U.S. Pat. Nos. 4,083,124; 3,694,939; 4,551,783; and 3,737,723. Electrically conductive elements comprising or extending through various shoe sole layers, such as a foot pad, insole, midsole and the like, in order to make contact with the bottom sole of the wearer's foot have been disclosed in various forms as, for example, in U.S. Pat. Nos. 2,261,072; 2,710,366; 3,079,530; 4,727,452; 4,366,630; 4,689,900; and 4,785,371. Other electrically conductive elements have been used in footwear designs such as described in U.S. Pat. Nos. 4,532,724 and 3,898,750. All these devices appear to be uncomfortable to wear, difficult and/or expensive to manufacture, unsightly and/or structurally awkward or unsound.

SUMMARY OF THE INVENTION

The instant invention relates to a shoe for creating an electrical conduit between a wearer's foot and the ground. The shoe includes a non-electrically conductive upper portion adapted to surround at least a portion of the wearer's foot; a non-electrically conductive shoe midsole; an electrically conductive shoe outsole, affixed to said upper portion, forming a bottom shoe surface adapted to effect substantial contact with the ground; an electrically conductive surface comprising a sock liner positioned inside a bottom of the upper portion of the shoe; and a conductive tape having a substantial part thereof rigidly mounted to said upper portion of the shoe to thereby provide electrical coupling between the outsole and the conductive sock liner of the shoe.

In a presently preferred embodiment of the invention, the outsole is conductive and is electrically coupled conductive tape that extends upwardly from the out-sole in the counter, or heel, portion of the shoe. The conductive tape extends into the interior of the shoe and makes contact with an electrically conductive sock liner. The sock liner provides complete contact with the wearer's foot regardless of the foot's orientation within, for example, the shoe while jumping, stepping off or landing. In another aspect of this embodiment, the outsole can be formed having a conductive extension up the counter, in contact with the counter stiffener on the shoe upper. The stiffener can be made of a conductive material and contact the conductive tape. Alternatively, the tape can extend into the shoe at a mid-portion between the sole and the shoe opening. This aspect has the benefit of reducing the length of tape required to contact the conductive insole. In another aspect of the invention, the conductive outsole can extend upwardly and directly contact the conductive tape that extends into the inner portion of the shoe.

Providing a conductive sock liner provides a more substantial connection between the wearer's foot and the conductive path so that an electrical charge from the environmental substrate can pass through the conductive outsole to the wearer to enhance the performance of the person wearing the shoe.

According to a presently preferred embodiment of the invention, the outsole is conductive and is electrically coupled to conductive tape that extends upwardly from the out-sole in the counter, or heel, portion of the shoe. The conductive tape extend into the interior of the shoe and makes contact with an electrically conductive sock liner. The sock liner provides complete contact with the wearer's foot regardless of the foot's orientation within, for example, the shoe while jumping, stepping off or landing. In another aspect of this embodiment, the outsole can be formed having a conductive extension up the counter, in contact with the counter stiffener on the shoe upper. The stiffener can be made of a conductive material and contact the conductive tape. Alternatively, the tape can extend into the shoe at a mid-portion between the sole and the shoe opening. This aspect has the benefit of reducing the length of tape required to contact the conductive insole. In another aspect of the invention, the conductive outsole can extend upwardly and directly contact the conductive tape that extends into the inner portion of the shoe.

Providing a conductive sock liner provides a more substantial connection between the wearer's foot and the conductive path so that an electrical charge from the environmental substrate can pass through the conductive outsole to the wearer to enhance the performance of the wearer.

Accordingly, it is an object of the present invention to provide a rugged integral footwear design which can control the dissipation of electrical charges between the body and the environmental substrate that the footwear normally makes contact with.

It is a further object to provide a shoe construction that brings a portion of the shoe that makes substantial contact with the ground during normal use, such as outsole, into direct electrical contact with the human body.

It is another object of the invention to provide a shoe that can improve human physical performance by harnessing the electrical force in the earth with the body's electrical energy.

The above, and other objects, features and advantages of the invention will be apparent in the following detailed description of exemplary embodiments of the invention which are to be read in connection with the accompanying drawings wherein:

DETAILED DESCRIPTION OF THE INVENTION

Figure 1:
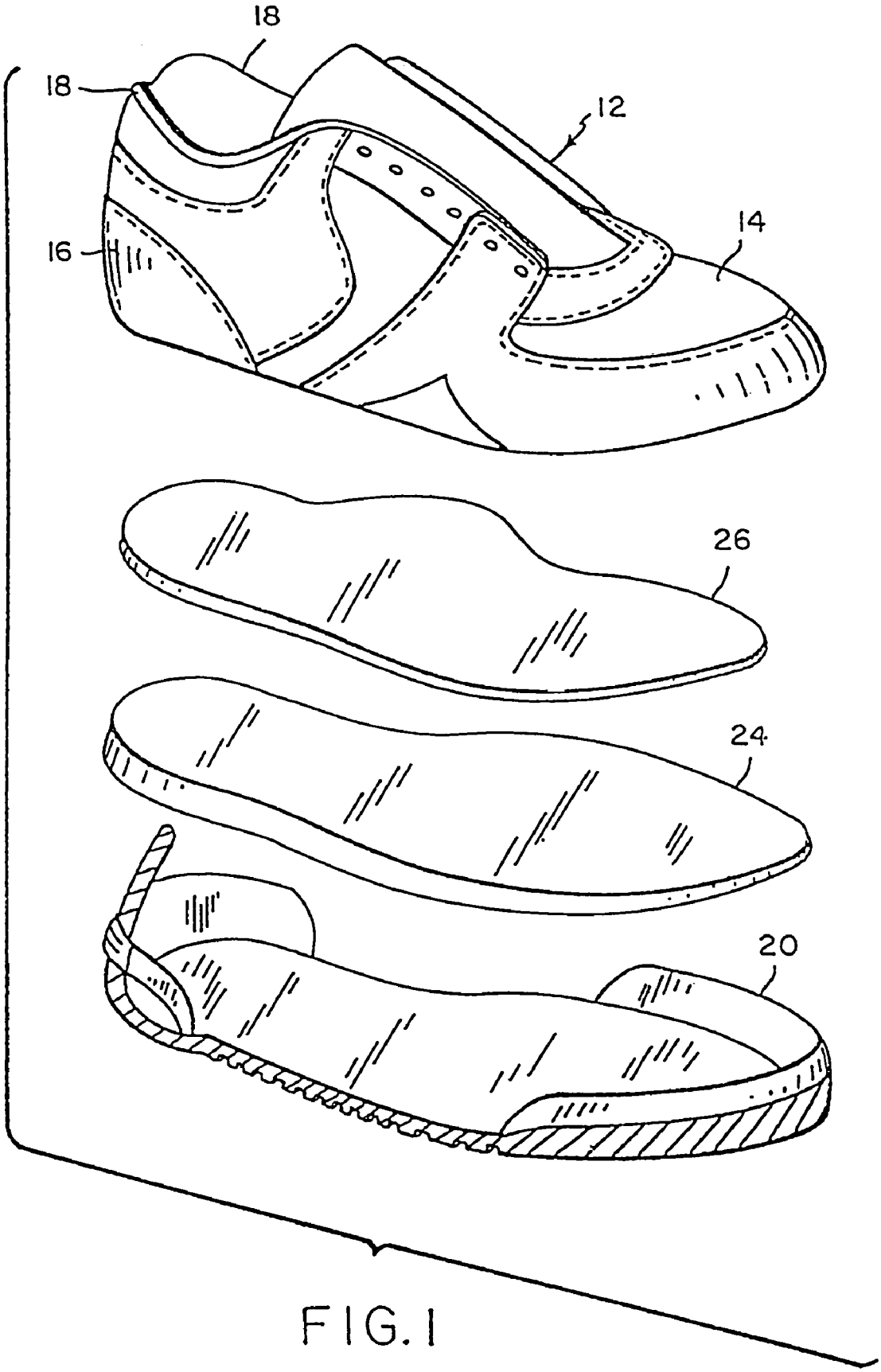
FIG. 1 is an exploded perspective view of an exemplary shoe design according to the present invention.

This invention pertains to a shoe that contains electrically conductive material designed to establish an electrical bond between the human body and the environmental substrate that the shoe normally makes contact with. In particular, establishment of an electrical contact between the human body and an environmental substrate (e.g. $10^5$-$10^6$ ohms-cm path to ground) can harness electrical energy in the environment with the body and enhance the physical performance of the wearer during activities such as jumping, lifting, throwing, pushing, pulling and the like.

Without wishing to be bound by any theory, it is well know that electrical fields can affect biological cells. In particular, electric fields can affect actin, a proteinaceous component of contractile muscle fibers. Moreover, it is well known that the earth and the atmosphere generate an electric field of approximately 100-150 volts per meter, this value increasing considerably under certain conditions. This so-called "coronal" electrical field in the earth/atmospheric system interacts with the human body so that a person can intercept approximately 260 volts of electricity generated by the earth and atmosphere.

Dr. Stephen Chang, one of the foremost practitioners of self-healing medicine (Taoist Medicine) in the Western World, emphasizes the importance of bodily electricity in the healing method simply using the movement of the hands as an electrical force passing back the energy created into the lower extremities of the body. Dr. Chang states "it was Western science who ingeniously verified the existence of electromagnetism and provided a means for the logical explanation for many of the previously unexplained phenomenon resulting from acupuncture therapy as well as the help enhancing benefits obtained through the practice of internal exercises. By learning the energizing internal exercises we are thus able to gain control over the vast energy upon which all life depends. We can then use this energy to heal ourselves as well as others and ensure our continued heal and spiritual growth. Accordingly, it is clear that the enhancing benefits obtained through the practice of Chi-Chong also will help enhance physical performance, as in the present invention.

The shoe design of the invention employs conventional polymeric materials as the conductive component. For example, the outsole of an athletic shoe, typically comprised of rubber that is non-conductive, is rendered electrically conductive by dispersing conductive particles or other conductive material(s) into the rubber. Such materials include electrically conductive carbon, silver, gold, or other metal particles, metal coated carbon particles, metal coated silica particles, metal flake particles and the like. Examples of specific materials which may be blended with a rubber to render it conductive are carbon blacks, such as XC 72 and N.550 carbon blacks. (Trademarks of the Cabot Corporation, Boston, Mass.). Most preferably, the conductive particles are homogeneously dispersed throughout the rubber by conventional blending methods to achieve an ohmic path between the body of the shoe wearer and the ground of between about $10^4$ and about $10^8$ ohms-cm, typically $10^5$ to $10^7$ ohms-cm. Without conductive material added thereto, rubber normally has an essentially infinite resistivity and is essentially completely non-conductive or resistive.

Figure 2:
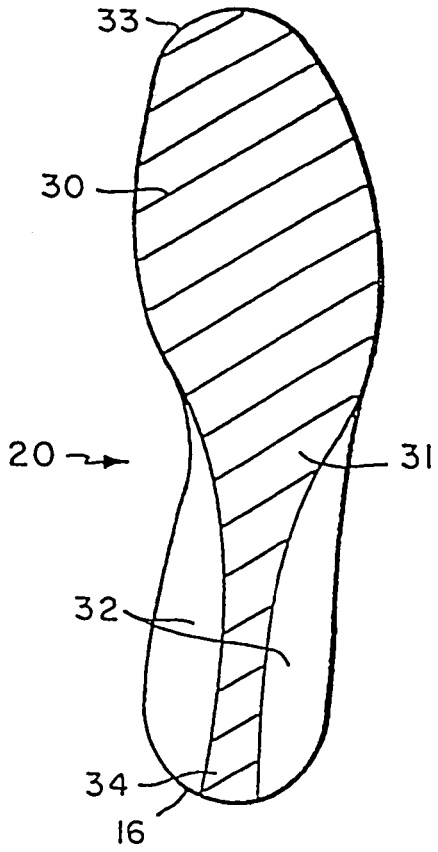
FIG. 2 is a bottom view of an embodiment of an electrically conductive outsole pattern.
Figure 3:
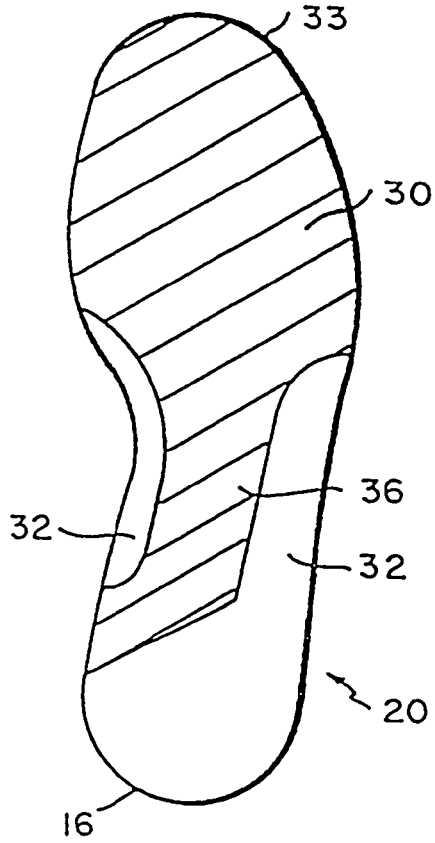
FIG. 3 is a bottom view of another embodiment of an electrically conductive outsole pattern according to the present invention.

As used herein the term "outsole" is meant to be any sole layer component of the shoe which makes substantial contact over a relatively wide area with the ground during normal wear such as by way of the exemplary outsole patterns shown in FIG. 2 and FIG. 3.

An integral extension of the ground contacting outsole extends upwardly from a peripheral edge of the outsole around the edge of the sock liner, insole and midsole to the "upper" of the shoe. The extension is integrally attached to the inside or outside surface of the shoe upper such that the conductive integral extension makes substantial contact with the foot of the wearer. The integral extension most preferably comprises the same conductive rubber material the outsole and the conductivity of the extension is preferably identical to the outsole material. The extension being unitary or integral with the outsole obviates any potential discontinuity in electrical flow, or faulty contact between separate conductive components that would otherwise have to be connected in order to establish conductive flow therebetween. In a most preferred embodiment, the extension is also integrally formed together with the upper of the shoe. The extension may be molded with or sewn or stitched with, or otherwise integrally attached, as by glue, to the non-conductive material of the shoe upper thereby obviating any potential of the extension becoming disengaged from the shoe upper or from contact with the foot. As used herein, glue is intended to broadly cover, without limitation, any adhesive, melting and subsequent affixing of the components, ultrasonic fusing or any means to affix the extension to the non-conductive upper.

Referring to FIG. 1, an athletic shoe of the present invention is illustrated generally at 10. The shoe is one of many possible styles and variations of footwear to which the present invention is applicable. Although the preferred embodiment of the invention is directed to an athletic shoe as shown in FIG. 1, the shoe may be one of other shoe types such as casual, loafer, flats, wedges, steel-toed safety, platform and the like.

Shoe 10 includes an upper, designated generally at 12. The upper 12 is formed of any material useful for shoe construction, as described in more detail below, to provide a forepart 14 and a counter or heel portion 16. The upper also includes a collar 18 which is typically the top line of the shoe that encircles the ankle of the wearer's foot.

Upper 12 is secured by known securement or welting techniques to an outsole generally designated 20 including an integrally formed heel portion, represented as a heel extension 22. Methods of matching the sole and other components to the upper are disclosed by the within author Cheskin et al., in "The Complete Handbook of Athletic Footwear"; Fairchild Publications, New York, (1987), the entire contents of which are incorporated herein by reference. The upper 12 is typically formed of leather, cloth, canvas or any other synthetic material such as polyvinyl chloride (PVC), polyurethane (PU) or so-called poromeric materials useful for shoe construction. Leather materials preferred in the production of footwear are, for example, leathers derived from calfskin, cowhide, pig, antelope, goat, deerskin and suede varieties of the above. Other material that can be used for the upper, especially in athletic footwear include PVC, nylons, and microporous sheet materials consisting of a PU material reinforced with polyester. Referring again to FIG. 1, a midsole 24 is adjacent to the outsole 12, preferably provided within the shoe in contact with the outsole. Provided within the shoe and juxtaposed relative to the midsole 24 is a sock liner 26.

The midsole 24 can be constructed made of a variety of materials. In athletic footwear, the midsole 24 provides shock absorption, comfort, and spring capability due to its resilience for enhancing physical performance by the wearer. Typically, PU materials are used to make midsoles that can be injection molded or cemented from various interfitted pieces to form a unitary or integral midsole. Preferably, the PV has a cellular structure with a Shore A hardness of between approximately 30 and 90. Another preferred midsole component is ethylvinyl acetate (EVA which forms a cellular structure when vulcanized with a Shore A hardness of between about 30 and 50.

Referring again to FIG. 1, the outsole 20 is preferably made from a rubber or rubber-like material, referred to herein as an elastomer. The term "elastomer" is meant to encompass materials including natural and synthetic rubbers possessing characteristic elastic properties, and/or any substances, including mixture containing natural rubber, that have rubber-like qualities. The outsole 20 is typically formed of carbon rubber and styrene-butadiene rubber. Black carbon rubber is the hardest wearing rubber and is preferably used in shoe constructions designed for running. Styrene-butadiene rubber is preferably used for flat-soled shoes for use in tennis and basketball. Other elastomeric materials useable in shoes according to the invention are disclosed in Cheskin et al., supra, pages 135-137, incorporated herein by reference and include Neoprene polychloroprene elastomers.

The outsole 20, is preferably molded from one of the elastomers described above and is formed as a mixture incorporating electrically conductive materials. The conductive material is typically carbon particles, but can be any other electrically conductive material such that the distribution of the conductive material in the rubber elastomer outsole material is sufficiently concentrated and homogeneous to provide an ohmic path between the foot and the ground having a resistance of between about $10^4$ and about $10^7$ ohms-cm. Stainless steel particles, and other metallic powders such as zinc oxide, for example, can be used with the elastomeric outsole materials. In preferred embodiments of the invention, conductive particles in combination with the elastomeric material of the outsole 20 provide a volume resistivity sufficient to provide an overall resistance from foot to ground through the outsole of between about $10^3$ and about $10^6$ ohms-cm. In a preferred exemplary embodiment, the heel extension 22 extending to the upper of the shoe is integrally formed with the outsole 20, and has the same resistivity. The resistivity values refer to conventional bulk or volume resistivity measurements which define current flow per unit area through a volume of material.

The structural design of the outsole can be configured in a variety of ways depending on the particular shoe type and activity that the shoe is designed for. As shown in an exemplary bottom sole outline in FIG. 2, the outsole 20 extends along at least a major portion of the length of the bottommost surface of the shoe 10 from the toe area 33 to the heel 16, beginning at a point proximate the ball of the foot and extending to the heel 16 of the foot. The electrically conductive material may comprise the entire outsole, or it may be proportionally smaller than the entire outsole 20 in order to define marginal non-conductive areas 32 that would not normally make contact with the ground. The sole pattern illustrated in FIG. 2 therefore includes an electrically conductive portion 30 (shown in lined outline) that has a substantially widened forward section under a forepart of the foot, a narrow instep section 31 and a narrow heel portion 34. This configuration has been found to be useful for court sports such as basketball o racquetball. The greater surface area is provided at the forepart of the foot so that conductivity can be transmitted to the push-off or jumping part of the foot.

In another embodiment of the outsole 20, shown in FIG. 3, a typical pattern of shoe outsole conductive portions 30 (shown in lined outline) for a shoe is designed primarily for running and walking. The electrically conductive elements conform in general shape to the forward portion under the forepart of the foot with a narrower instep portion 36 being defined under the arch of the foot, having non-conductive areas 32.

Figure 4:
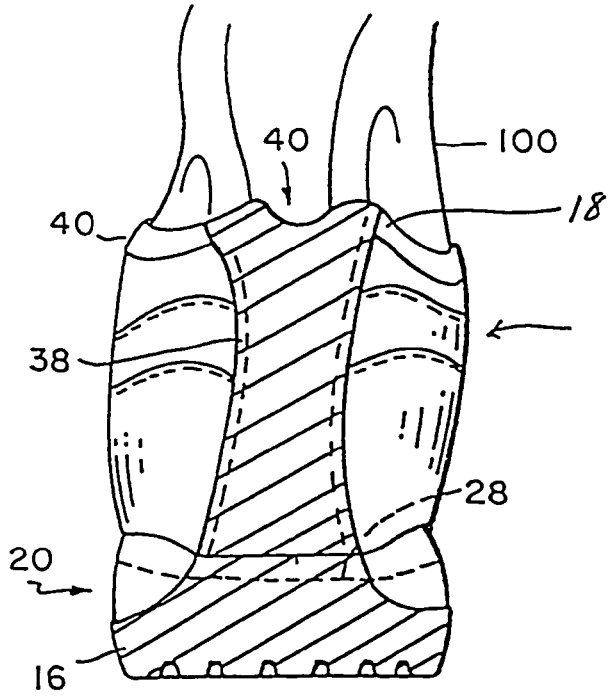
FIG. 4 is a rear view of a shoe design.

In order to provide an electrical conduit between the environmental substrate and the wearer's body, an integral extension 38, as shown FIG. 4, extends upwardly from the bottom of the outsole to make contact with the body. The integral extension may be formed of one piece with the outsole. Alternatively, the extension may be formed separately and then securely attached to the outsole. In one preferred embodiment, the integral member 38 extends from the outer edge periphery of the outsole 20 up to the shoe collar 18 where it contacts the wearer's foot or sock.

Figure 5:
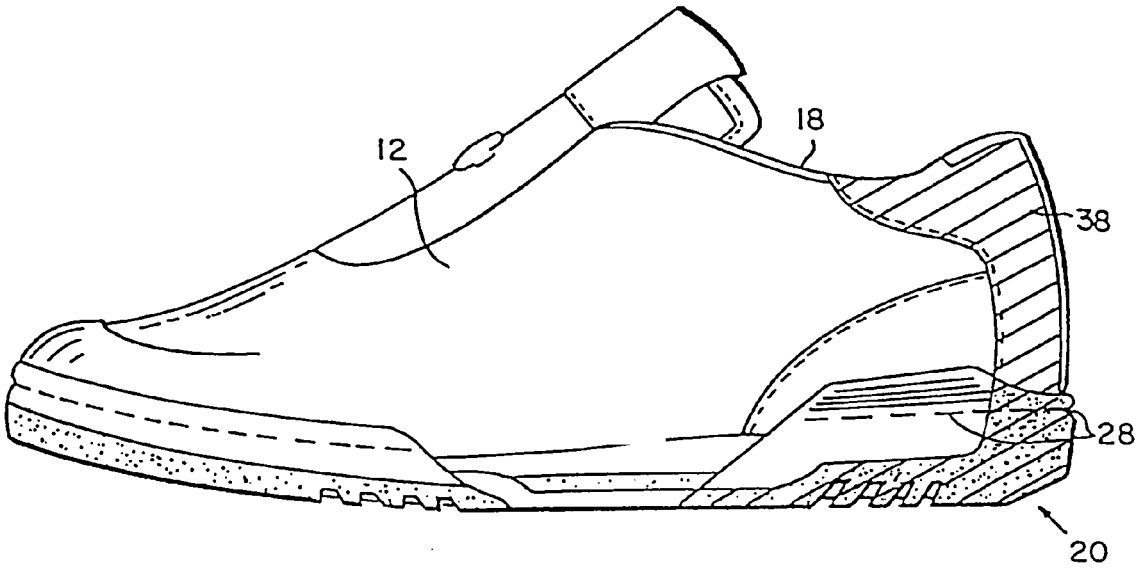
FIG. 5 is a side view of another embodiment of a shoe design according to the present invention.
Figure 6:
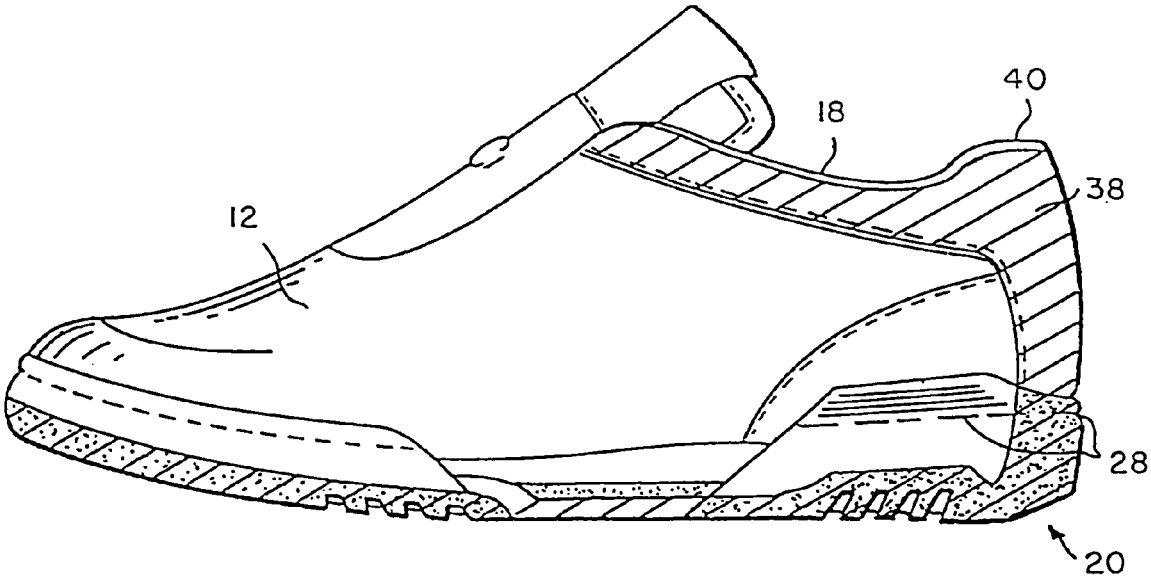
FIG. 6 is a side view of another embodiment of a shoe design.

In the embodiments shown in FIGS. 5-6 the outsole 20 is shown with stippling to schematically represent conductive particles dispersed throughout the rubber outsole material and the conductive extension 38 is shown in lined outline. As described herein, the extension may be integrally formed with the outsole, for example, by molding as a unitary extension of the normal outsole pattern Alternatively the extension may be made unitary with the outsole by welding a separately molded extension 38 onto a separately molded outsole by conventional methods, wherein the separate outsole and separate extension are overlapped and melted together and then resolidified to form a unitary overlapped area.

The extension 38 and the outsole 20 may alternatively be made integral with each other by stitching 28 the two overlapping portions together such that the separate components are in structurally permanent and integral conductive contact with each other. In a preferred embodiment the extension 38 comprises the same rubber material, including the same conductive particles or other material dispersed in its rubber matrix as the outsole. In any event, the bulk or volume resistivity of the extension 38 is in the same preferred range as the outsole 20. Most preferably the volume resistivities of the two are the same.

In one embodiment shown in FIG. 4, an integral extension 38 of the outsole 20 extends upwardly over the outside surface of the heel strip area of the upper 12. As shown by the dashed line area in FIG. 4, the extension 38 extends up to the top 40 of the collar 18 in the heel area 16. Typically, the extension 38 is positioned over the edge of the collar and at least slightly downwardly over the top 40 along the inside surface of the upper 12 in the collar area to insure contact with the rearwardmost heel area of the foot/ankle 100 during normal wear.

In another embodiment shown in side view in FIG. 5, a heel area extension 38 integral with outsole 20 extends over the outside surface of the heel area of upper 12 and about halfway around the collar 18 in the rear thereof. Preferably the extension 38 extends over the top of the collar 18 and at least slightly downwardly along the inside surface of the collar 18 to insure contact with the foot during normal use. In another alternative embodiment, shown in FIG. 6, the extension 38 extends around the entire collar 18 and slightly downwardly inside the collar area.

Figure 7:
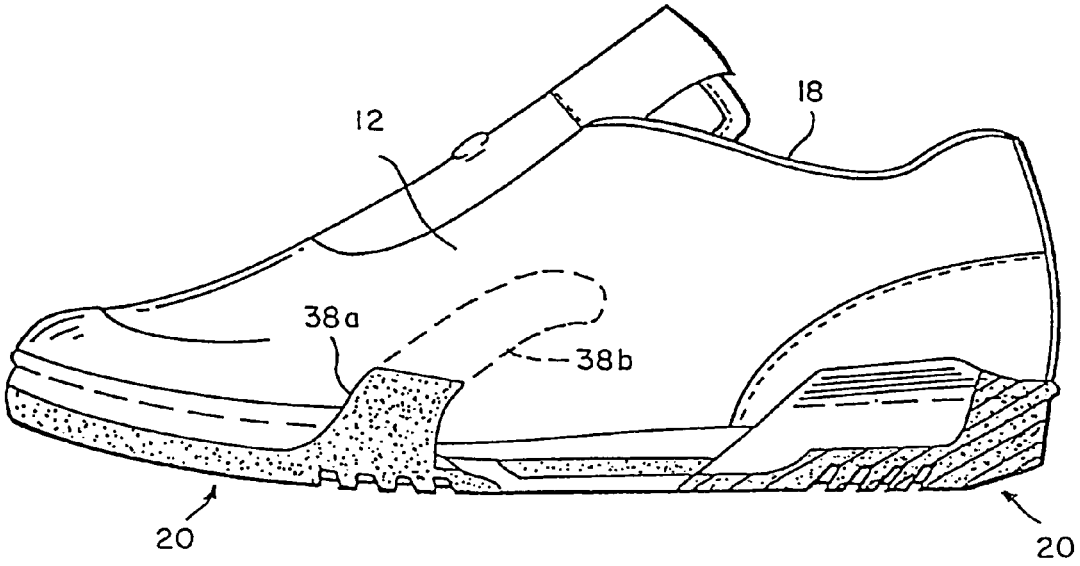
FIG. 7 is a side view of another embodiment of a shoe design according to the present invention.

In another embodiment, an integral extension 38*a* and 38*b* may extend upwardly along an inside surface of the upper as shown by the dashed lines in FIG. 7. where the extension is configured to extend along the inside surface of the upper, the extension may more easily be disposed along a forward or anterior surface of the upper as shown in FIG. 7. In the FIG. 7 embodiment, the integral extension comprises a first portion 38*a* extending upwardly from the outsole 20 over the outside surface of an anterior portion of the upper 12. A second portion 38*b*, integrally extending from portion 38*a*, extends through an aperture in the upper 12 and along a portion of the inside surface of the upper 12 to make direct contact with the wearer's foot. In a similar fashion, the extension 38*b* could be configured to extend along the inside surface of the upper beginning at a lower point, for example, at the peripheral edge of the upper. In any case, the extension extends around the peripheral edges of any shoe sole layers which may be disposed on top of the outsole 20. An extension extending along an inside surface of the upper can more readily insure contact with the wearer's foot.

Figure 8:
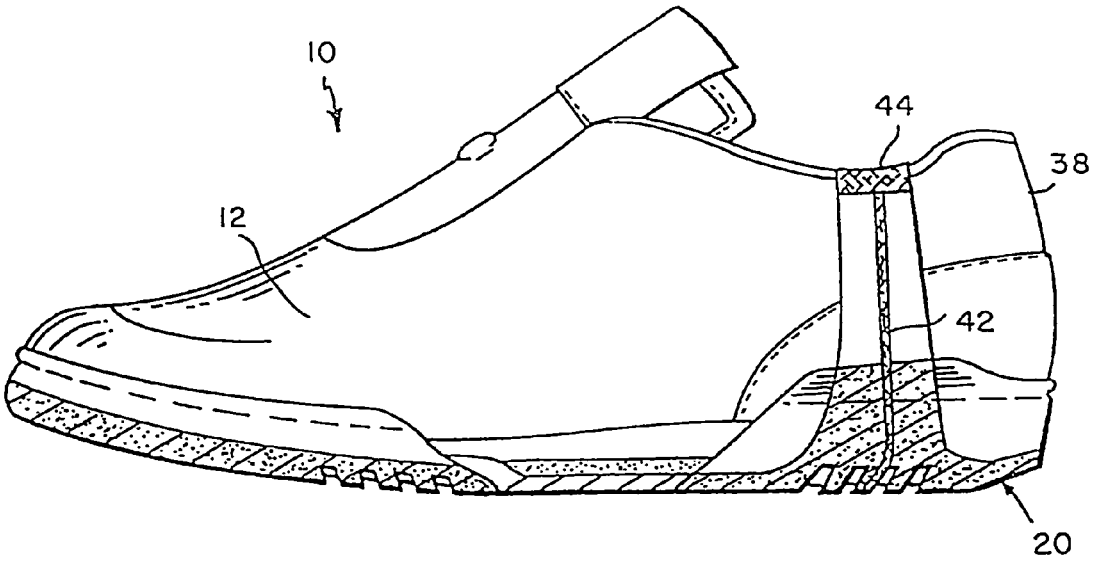
FIG. 8 is a side view of another embodiment of a shoe design.

In an embodiment shown in FIG. 8, the extension member 38 containing a conductive wire 42, embedded within the rubber matrix of extension 38, is affixed to the side of the shoe upper rather than to the back of the heel. FIG. 8 illustrates member 38 extending upwardly in a perpendicular direction from the side of the heel and terminating in a conductive clip 44. The clip 44 extends over the collar along an inside surface of the shoe such that a portion of the wearer's foot adjacent the ankle bone has contact with the clip during normal wear. As shown in FIG. 8, a lower portion of the member 38 (stippled) contains conductive particles dispersed throughout and an upper portion shown in blank outline does not contain conductive particles. The conductive wire 42 creates an electrical conduit between the conductive clip 44 and the conductive outsole 20 in lieu of conductive particles being dispersed within the upper blank portion of integral extension 38. Although the blank portion of integral extension 38 does not contain conductive particles, they may be included to work in conjunction with wire 42 and create an electrical conduit. The extensions 38 shown in all embodiments are stitched, sewn, welded or otherwise fixedly attached to the upper 12 such that the extension 38 is essentially integral with the upper.

In all embodiments, the extension preferably extends upwardly from a peripheral edge of the outsole 20 around and above the peripheral edge of any sole layers disposed on top of the outsole 20.

Figure 9:
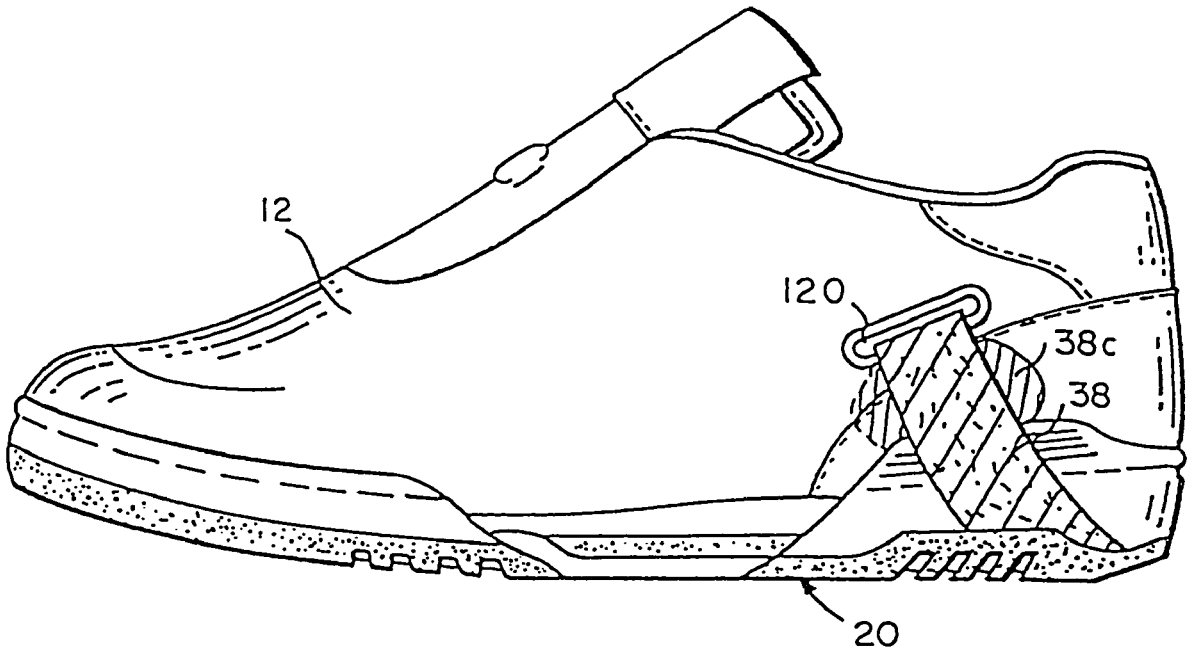
FIG. 9 is a side view of another embodiment of a shoe design according to the present invention.

In another embodiment shown in FIG. 9, the extension 38 extends upwardly along the outside of the upper 12, through a slot 120 and then downwardly forming a flap 38*c* along an inside surface. The flap 38*c* is preferably attachable to the inside surface of the upper 12, for example, by any suitable attachment device such as a hook and loop fastener material.

In another alternative embodiment of the invention, the entire inside surface of the upper 12 may be lined with a conductive cloth material such as Thunderon material (available from Nippon Sammo Dyeing Co., Ltd., Kyoto, Japan). In such an embodiment (not shown), the extension 38 could be disposed in contact with the conductive cloth lining on the inside surface of the upper 12 in such a manner as shown in and described with reference to FIG. 9.

Figure 10:
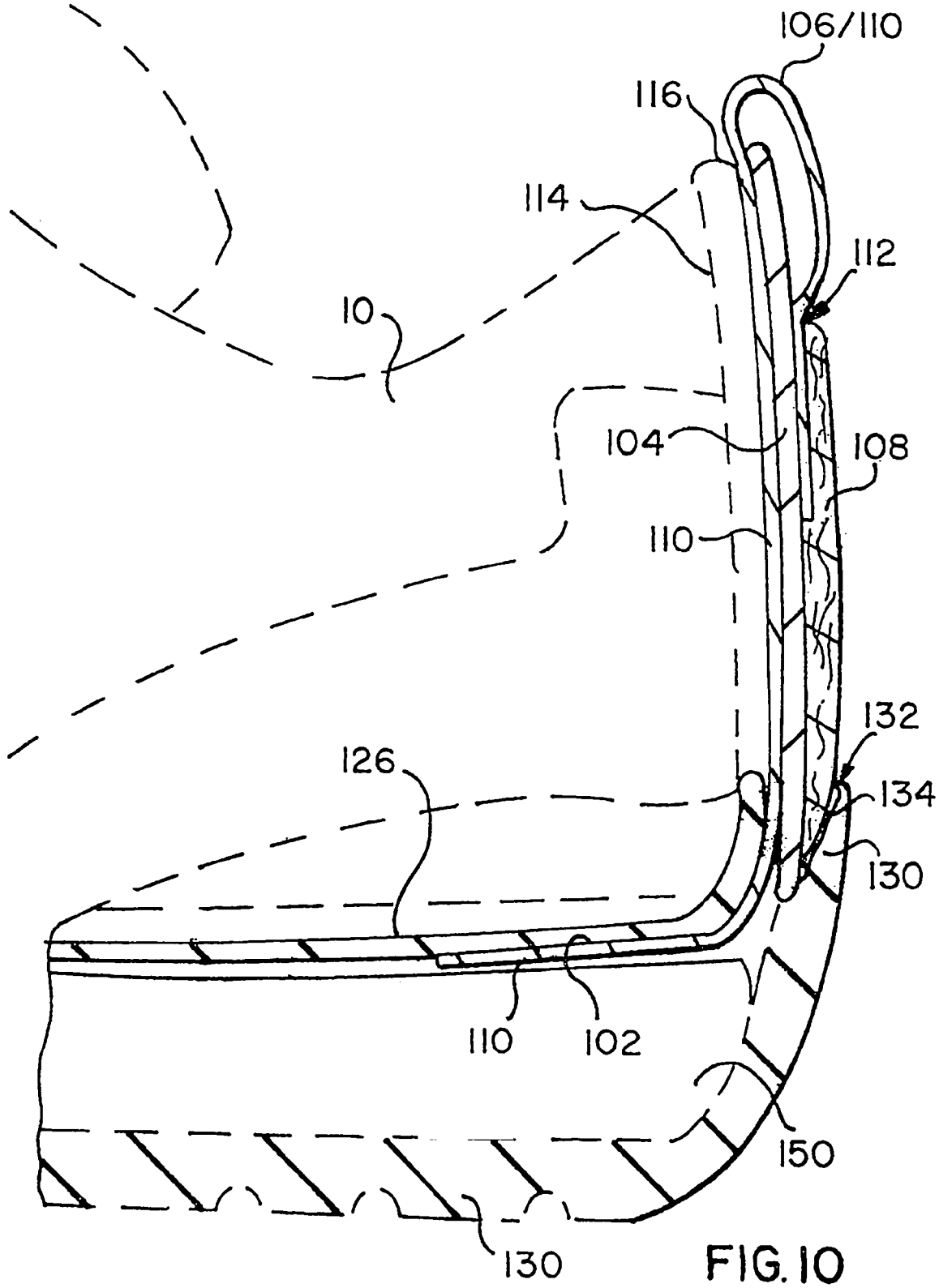
FIG. 10 is a cutaway side view of another embodiment of a shoe design.

FIG. 10 illustrates an embodiment of the invention which utilizes a conductive sock liner 126, conductive tape 110 and a conductive outsole 130 to form the electrical connection between the wearer and the ground. As shown in FIG. 10, the conductive tape 110 is placed In contact with the conductive sock liner 126 at the heel of the sock liner, indicated at 102. The conductive tape extends up the heel along the interior surface of counter 104.

The conductive tape 110 is securely mounted to the counter 104 along at least a substantial portion of its length. This maintains the tape's contact with the shoe, and provides good conduction for transferring electrical energy from the ground to the wearer.

As is well known to those skilled in the art, the counter 104 provides rigidity and stability in the rear portion of the shoe, and is typically constructed of a rigid plastic or hard cardboard material. At the upper portion of the counter, the tape may protrude from the interior of the shoe and form a loop 106. The conductive tape is secured to the outside of the counter by a counter cover 108 that can be stitched to the counter, as shown at 112, or the two portions can be integrally molded. Alternatively, the counter cover 108 may be affixed to the counter 104 by an adhesive material. The counter cover is constructed of rubber with conductive particles disposed therein.

The conductive counter cover 108 is attached to the outsole 130 at a conductive outsole tab 132 that extends upwardly along a heel of the shoe. As shown, the conductive counter cover 108 is disposed underneath the tab 132. However, as would be apparent to those skilled in the art, the conductive outsole tab 132 can be disposed inside the counter cover. Additionally, it may be connected by any suitable means. If the conductive cover 108 is connected to the conductive outsole 130 at 134 by means of an adhesive, the adhesive may be conductive so that the electrical connection between the outsole and the cover is maintained. Alternatively, the conductive tape may extend down to the conductive outsole and contact the outsole directly.

The conductive tape may be constructed of ResistatO fiber (a registered trademark of BASF Corporation) which is a carbon suffused fiber that includes a chemically permanently bonded conductive carbon to the surface of a nylon fiber. The resestivity range is between $10^4$ and $10^7$ ohms-cm. Conductive fibers are woven to form the conductive tape. In a preferred embodiment, the ResistatO tape most suitable is type F9322 180/65 conductive yarn (180 indicates the total denier and 65 indicates the filament count).

This tape provides an electrical conduit between the outersole 130 and the sock liner 126 and also has the strength to withstand pulling or tension. The ability to withstand tension is particularly well suited for this embodiment in that the tab 106 can be used to facilitate putting the shoe on a wearer's foot by pulling from the tab's loop.

The conductive tape may be disposed between the inner shoe padding 114 and the counter 104. When so disposed, it is protected from the rubbing motion of a wearer's foot as the shoe is put on and taken off. The conductive tape 110 may be stitched at the uppermost portion of the inner padding, at the collar portion of the shoe, as indicated at 116. If the conductive tape is disposed between the inner padding 114 of the shoe and the counter, the tape passes down the inside surface of the counter to a location adjacent the conductive sock liner. The tape extends a sufficient distance along the upper surface of the midsole and the lower surface of the sock liner 126 to provide good electrical contact between the conductive sock liner and the tape.

In a preferred embodiment, the tape extends two and one half inches along the bottom of the shoe. As will be apparent to those skilled in the art, the tape may extend a greater or lesser distance inside the shoe depending on specific characteristics of material that is chosen. The conductive sock liner is constructed of an EVA "carbonated" material having a woven laminate covering. The woven laminate covering includes a conductive metallic thread woven in the fabric. The laminate covering covers the plantar engaging surface of the sock liner 126. A conductive adhesive may be used to adhere the laminate covering.

Figure 11:
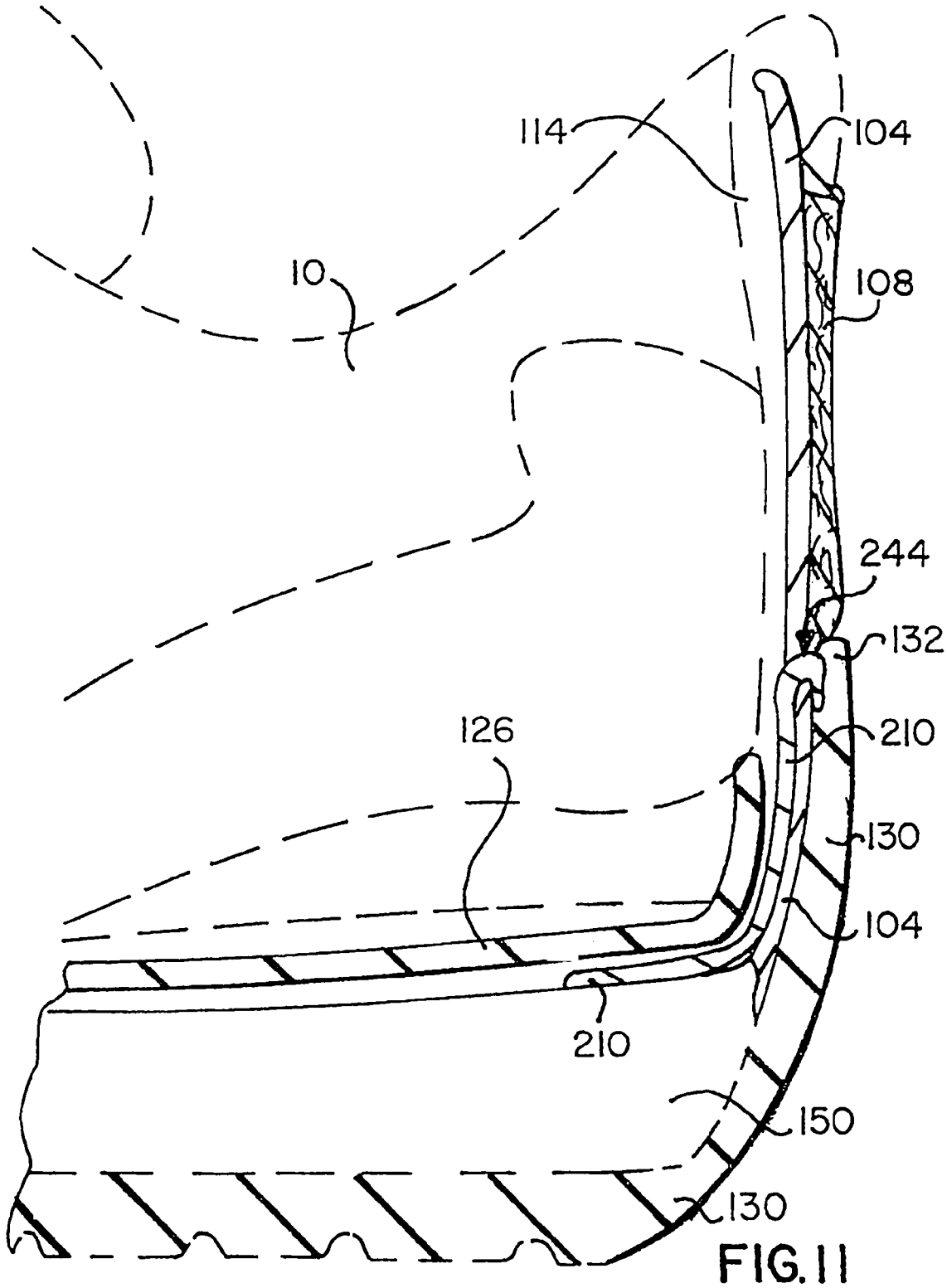
FIG. 11 is a cutaway side view of fourth embodiment of a shoe design according to the present invention.

FIG. 11 shows another embodiment of the invention using the conductive sock liner 126. In this embodiment the conductive sock liner is electrically connected to the conductive outsole 130 by means of ResistatO fiber tape 210. The Resistate tape is electrically coupled to the outersole 120 at the upwardly extending tab portion 132 and passes through counter 104 through a hole indicated at 244. The conductive tape 210 extends downwardly and contacts the rear of the sock liner 126. When the shoe is worn, the wearer's foot is always in contact with at least a portion of the conductive sock liner, which is in contact with the conductive tape. Additionally, the ResistatO tape may be rigidly mounted on the conductive outsole by means of a conductive adhesive or any other method that would provide a secure electrical connection between the conductive tape and the conductive outsole.

With reference to each of the embodiments disclosed in FIGS. 10 and 11, the use of a conductive sock liner assures a good electrical contact between the wearer's foot and the conductive outsole. The particular components which provide the electrical conduit are chosen to allow other parts of the shoe to be made of non-conductive material. For example, when constructing athletic shoes, it is often important to have a wedge 150, made of an elastomeric material, which cushions the wearer's foot as it hits the ground. With the present invention, the benefits of being electrically connected to the ground can be obtained without sacrificing the cushioning function of the wedge 150. Even if part of the wedge, or all of the wedge, is conductive, a barrier may be created between the conductive sock liner and the wedge by other shoe components or adhesives, and as such, the electrical connection of the present invention is advantageous.

Figure 13:
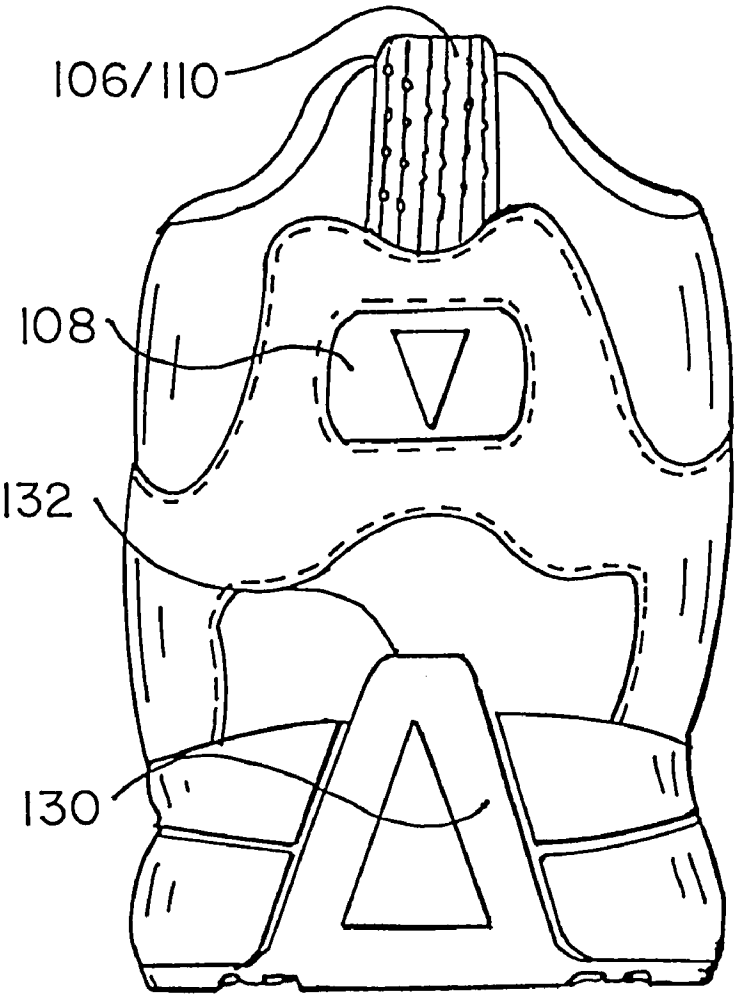
FIG. 13 is a rear view of variation of the embodiment of FIG. 12.
Figure 12:
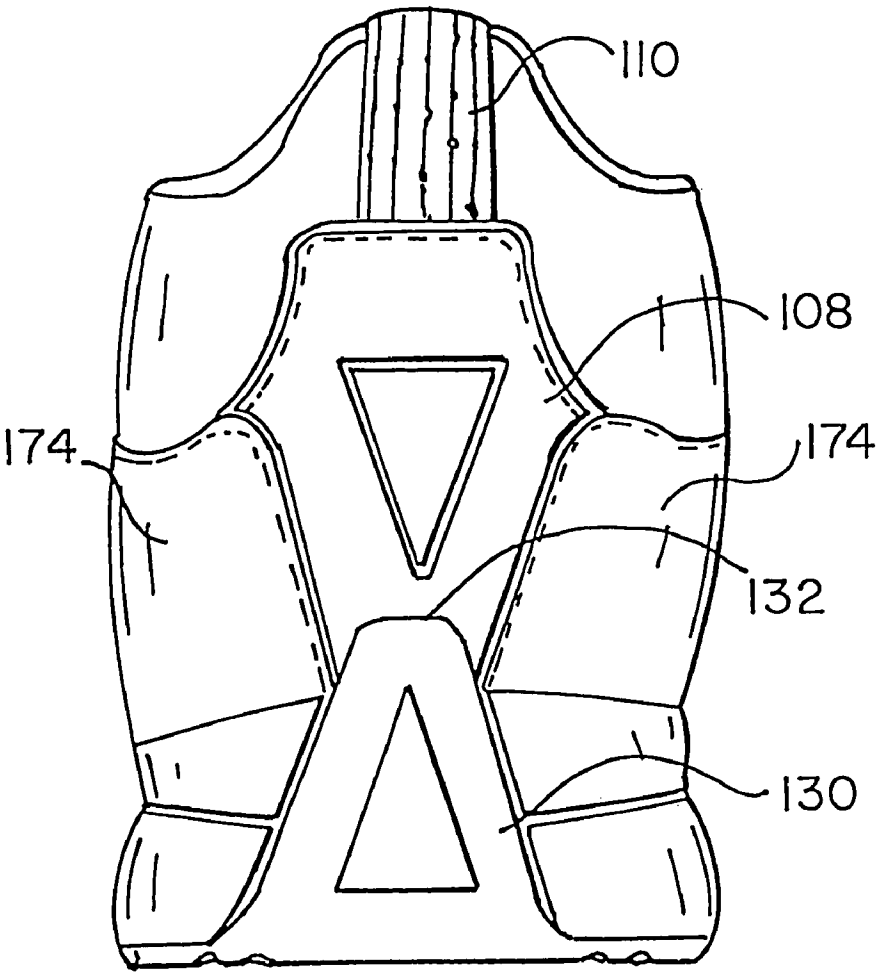
FIG. 12 is a rear view yet further embodiment of a shoe design.

FIGS. 12 and 13 are rear views of two alternative embodiments of the present invention. Conductive tape 110 is connected to the conductive outsole 130 by means of a counter cover 108. The counter cover, as shown in FIG. 12 is disposed at the heel of the shoe and various shoe upper components 174 are stitched to the counter cover.

FIG. 13 shows the conductive tape 110 connected to the counter cover 108 and the upper material, which can be selected from among a canvas cloth, leather, or other sheet material, is stitched around the counter cover. The counter cover is integrally molded with the outsole 130 and such integral molding provides the connection between the tape and the outsole.

Figure 14:
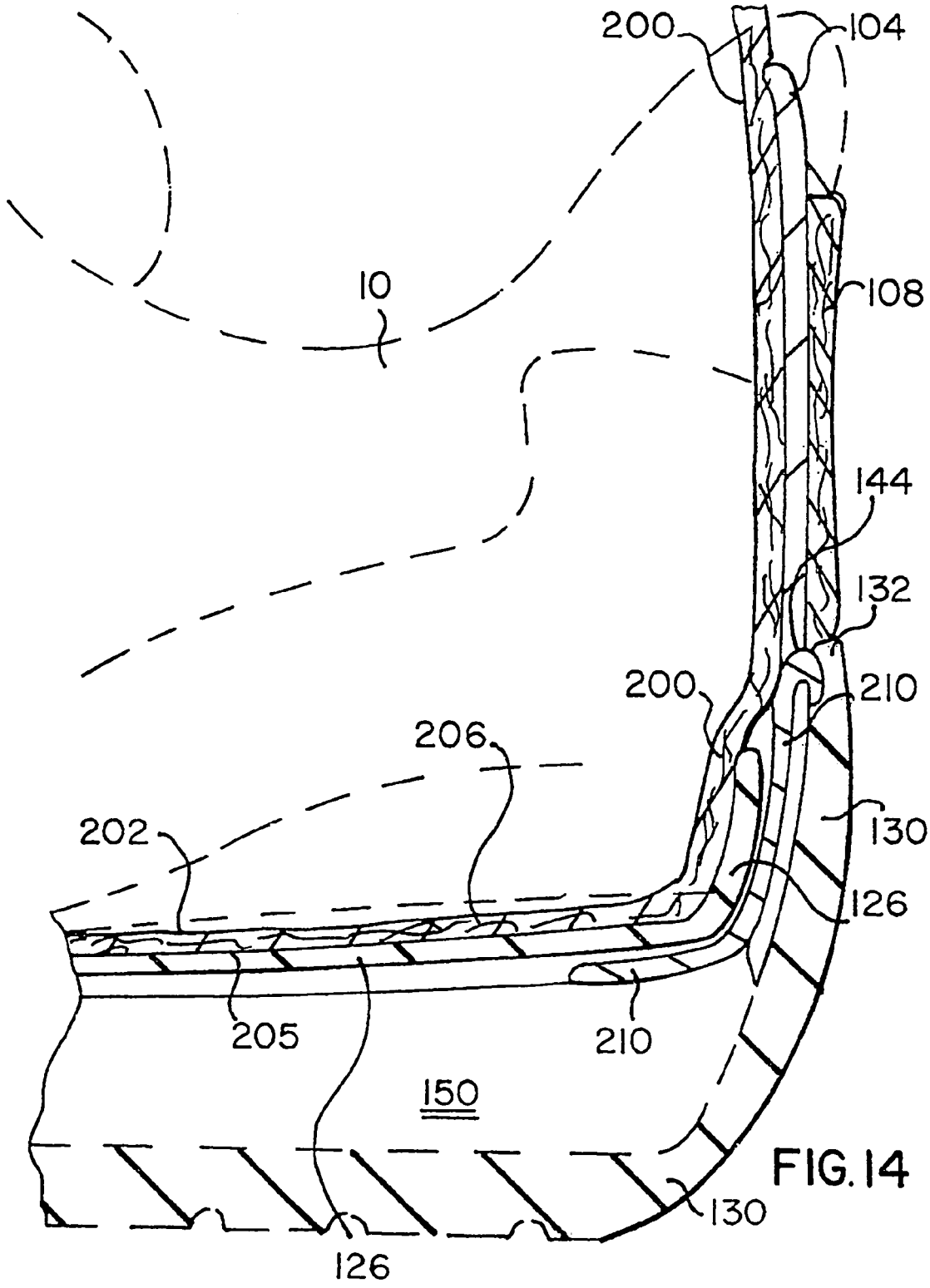
FIG. 14 is a cutaway side view showing use of a conductive sock with the inventive shoe.
Figure 15:
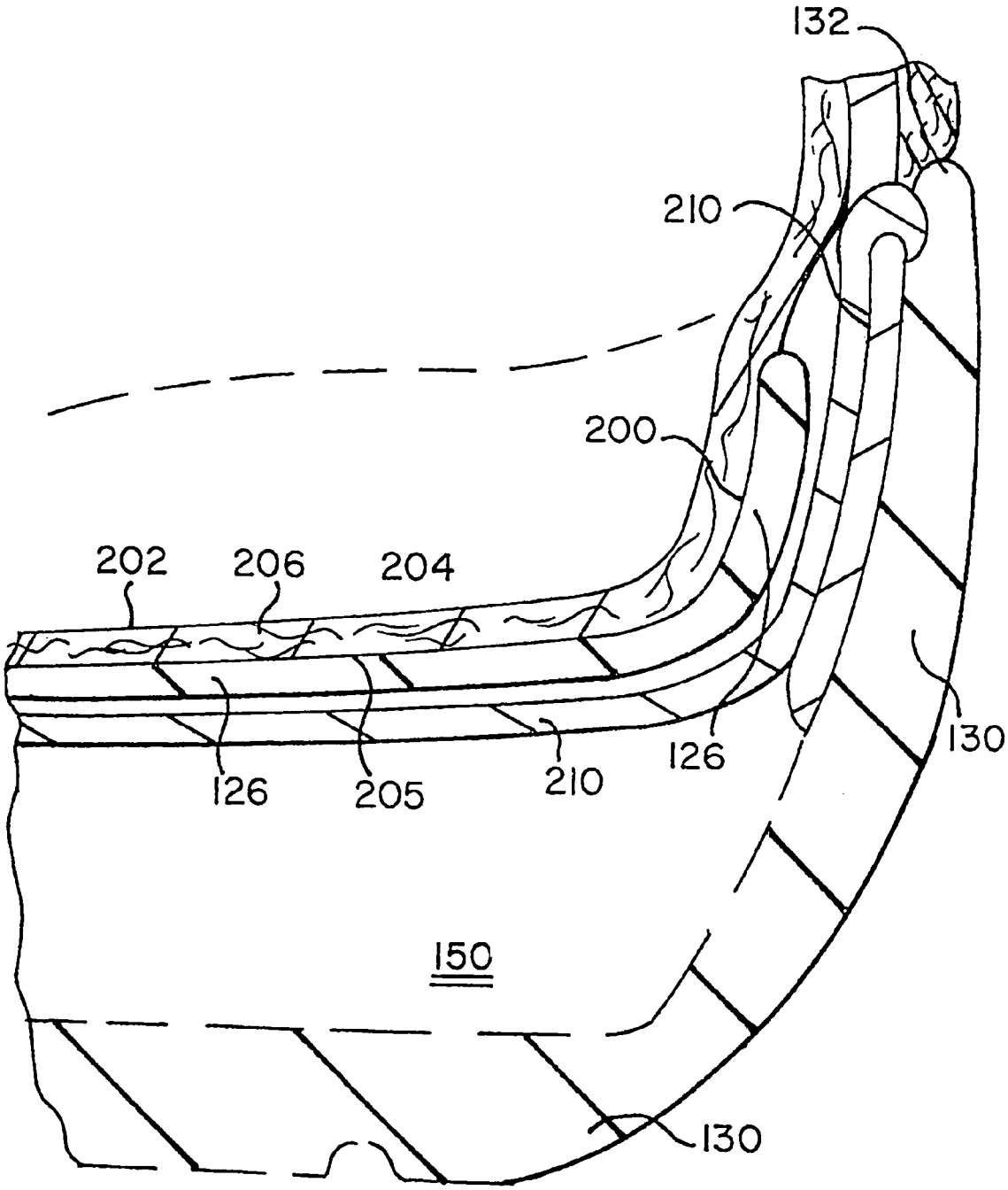
FIG. 15 is an enlarged view showing the fine structure of the conductive sock of FIG. 14.

With reference to the cross-sectional breakaway view of FIG. 14, and the enlarged view of FIG. 15. It is to be appreciated that the above described shoe with integrally conductive elements may be advantageously used with a sock 200 including a plantar surface 202 which, through means such as knitting, weaving, or implantation, is provided with conductive fibers 206 to preclude any possible insulative function of such surface. The resultant conductivity of the sock 200 is preferably in a range of $10^6$ to $10^7$ ohms between opposing sides of plantar surface 202. The anti-static conductive-fiber plantar surface may be formed integrally, along an interface 204 within a lower region 205 of an otherwise conventional sock. It is to be appreciated that the conductive fibers 206 preferably extend through the entire thickness of the sock, thereby assuring conductive contact between a foot 208 of the use and sock liner 126 of the conductive shoe 10. Electrical communication between the plantar surface and adjacent areas of the foot of the user and the insole of the conductive shoe is thereby assured. Therein, any potential insulative barrier that would otherwise be formed by the sock is eliminated, regardless of the thickness thereof.

It should be understood that there exist a number of fibers suitable for use with the inventive sock 200, these including fibers of cotton, acrylic, nylon, LYCRA (a DuPont trademark), wool, polyester, silk and polypropylene. Such fibers preferably exhibit a thread density in a range of 15 to 50 per lineal centimeter.

It is noted that while existence of individual fibers having a conductivity in the above range are known in the art, the effect of integration of such prior art fibers into known materials of the above set forth would be of fabric having only 1 to 2 percent by weight of the entire fabric. Thereby, the actual electrical resistance of the sock that would result from such a process would be too great to achieve an electrical path, through the plantar surface of the sock, having a conductivity in the desired range. Accordingly, the conductive sock 200 will require either a high percentage fibers of appropriate conductivity or a smaller percent of fibers having a much greater conductivity such that the aggregate bulk effect upon the entire plantar surface of the sock will be sufficient to produce an average conductivity between opposing surfaces in a range $10^6$ to $10^7$ ohms.

The electrical conduit created between the wearer's foot and the ground imparts a greater ability in the wearer to perform physical tasks relative to the same wearer wearing a shoe which does not provide such an electrical conduit. The following experiments demonstrate a significant increase in physical performance when wearing a shoe according to the invention. In each of the following described experiments the subjects, performances of physical exercises were carried out first on a non-conductive surface and then while standing, wearing only socks, on a sheet of conductive rubber according to the invention. The conductive conduit created between the wearer's foot and the ground by standing on a sheet of outsole conductive rubber is the same as is created when the wearer is wearing any shoe embodiment according to the invention. This was confirmed by measuring the conductivity between the foot and ground of a person standing on a sheet of outsole conductive rubber according to the invention and of the same person standing in a shoe having a mock up design most similar to the FIG. 6 embodiment with a conventional dissipative tester, such as a model FT-2630 FOOTWEAR TESTER, available from Plastic Systems, Inc., Marlborough, Mass., at a setting of $10^6$ ohms. In the following experiments (1) a sheet of rubber containing 40 parts of XC-72 carbon black (available from Cabot Corporation of Boston, Mass.) per hundred parts of rubber, and: (2) a sheet containing 40 parts of N.550 carbon black (Cabot Corporation) per hundred parts of rubber, were used as the conductive rubber components. The conductive rubber sheet was measured for volume resistivity and found to have a volume resistivity of about 37.5 ohms-cm. The ohmic path between a person and the ground was measured with the person standing on a copper ground plane and holding a copper bar connected to a positive electrode at chest level. Standing on the ground plane in non-conductive rubber outsoled shoes, no conductivity could be recorded. Standing with socks only on the ground plane a resistance of 90,000 ohms was measured. Standing in socks on the test sheet of conductive rubber which in turn was lying on top of the ground plane, a resistance of 195,000 ohms was measured.

In the following examples, the physical performance comparisons were made between people first standing in stocking feet on a non-conductive surface, and second with the same people standing with their socks on, on top of the sheet of conductive test rubber described above with the rubber sheet lying on the floor.

EXAMPLE I

Fourteen (14) male subjects of about average health, height and weight between the ages of 12 and 48 were tested for increase in their ability to leap vertically upwards from an initial standstill. The subjects stood against a wall with one arm stretched upward to a maximum defining a vertical starting point. With feet spaced about 12 inches apart, the subjects first jumped upwardly as high as possible In stocking feet while standing on conventional non-conductive material (such as insulated rubber) and then in stocking feet initially standing on a sheet of grounded conductive rubber according to the invention. The subjects exhibited the following percentage increases in leap height when standing on the grounded conductive rubber: (a) 12.4%, (b) 3.5%, (c) 4.5%, (d) 4.6%, (e) 10.0%. (f) 23%, (g) 13.5%, (h) 8.50%., (i) 9.5%., (j) 11.6%, (k) 1.1%, (l) 11.2%, (m) 3.5%, (n) 4.5%.

EXAMPLE II

Three (3) male subjects of about average health, height and weight between the ages of 22 and 48 were tested for increased ability to perform weight lifting "curls." Using a Marcy' Fastrack EMI weightlifting apparatus, each subject with feet spaced about 12 inches apart first attempted to curl the maximum amount of weight possible wearing non-conductive athletic footwear. The results for the three subjects were (a) 180 lbs., (b) 180 lbs., and (c) 170 lbs. Standing on a grounded conductive outsole sheet according to the invention, the three subjects next were able to lift a maximum of (a) 190 lbs., (b) 190 lbs, and (c) 180 lbs., an average of about a 6% increase.

EXAMPLE III

Seven (7) male subjects of about average health, height and weight between the ages of 22 and 48 were tested for increased ability to compress to the maximum extent possible a manual compression exercise apparatus, known commercially as Bullworker Super XS apparatus, which is disclosed in U.S. Pat. No. 4,290,600. With feet spaced about 12 inches apart, each subject attempted to compress the Bullworker compression device first wearing non-conductive shoes and then standing in stocking feet on a sheet of grounded conductive rubber according to the invention. The subjects exhibited the following percentage increases in the maximum amount (measured in pounds) which they were able to manually compress the device: (a) 7.5%, (b) 7.5%, (c) 15%, (d) 6.30%, (e) 2%, (f) 5%., (g) 3%. The average increase was, therefore, 6.6%.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

I claim:

1. A shoe for creating an electrical conduit between a wearer's foot and the ground, the shoe comprising:

(a) a non-electrically conductive upper portion adapted to at least partially surround the wearer's foot;

(b) a non-electrically conductive shoe sole layer component;

(c) an electrically conductive shoe outsole rigidly and non-removably affixed below said non-electrical conductive shoe sole layer and to said upper portion, said outsole forming a bottom shoe surface adapted to make substantial contact with the ground;

(b) an electrically conductive sock liner positioned inside of said upper portion of the shoe;

(e) a conductive tape having a length, a substantial part of which is rigidly mounted to said upper portion to thereby provide electrical communication between said outsole and said conductive sock liner, said conductive tape extending between a counter cover and said conductive sock liner to form a loop above a heel of said upper portion of the shoe and further extending into the interior of the shoe between said counter cover and interior padding of said shoe.

2. The shoe as recited in claim 1 in which said conductive outsole comprises:

a tab which extends onto a heel portion, the tab being electrically coupled to a conductive material inside the shoe.

3. The shoe as recited in claim 1 in which said conductive outsole is integrally attached to said counter cover, the counter cover comprising said conductive material, said material electrically coupled to the counter cover.

4. The shoe as recited in claim 1, in which said conductive tape comprises:

means for electrical communication between said outsole and said conductive sock liner, said tape extending along an outer surface of the shoe and into the shoe between interior padding and said counter, and downwardly to said sock liner.

5. The shoe as recited in claim 1, in which said conductive tape communicates with said conductive sock liner at a bottom surface thereof.

6. The shoe as recited in claim 1, in which the conductive tape extends to a heel portion of the shoe and is rigidly and non-removably fixed to a counter cover of the shoe.

7. The shoe as recited in claim 1, in which said counter cover includes an aperture allowing said conductive tape to pass therethrough from said outside of the shoe to an inside thereof.

* * * * *